US006261216B1

(12) United States Patent
Goldstein

(10) Patent No.: US 6,261,216 B1
(45) **Date of Patent: *Jul. 17, 2001**

(54) RIBBON CURLING AND SHREDDING DEVICE

(75) Inventor: Fredric Goldstein, Nacka (SE)

(73) Assignee: Group One Limited, St. Helier (GB)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

This patent is subject to a terminal disclaimer.

(21) Appl. No.: 09/215,730

(22) Filed: Dec. 18, 1998

Related U.S. Application Data

(63) Continuation of application No. 08/902,538, filed on Jul. 29, 1997, now Pat. No. 5,916,081, which is a continuation of application No. 08/650,493, filed on May 20, 1996, now Pat. No. 5,711,752, which is a continuation-in-part of application No. 08/244,022, filed on May 13, 1994, now Pat. No. 5,518,492.

(30) Foreign Application Priority Data

Nov. 14, 1991 (GB) ..... 9124249
Nov. 12, 1992 (WO) ..... PCT/EP92/02636

(51) Int. Cl.[7] ..... B31F 1/14; B31F 1/00
(52) U.S. Cl. ..... 493/459; 493/460
(58) Field of Search ..... 493/459, 460, 493/461, 352, 363, 401, 462, 365; 53/202

(56) References Cited

U.S. PATENT DOCUMENTS

| | | | | |
|---|---|---|---|---|
| 2,669,913 | | 2/1954 | Cerone . | |
| 3,327,915 | | 6/1967 | Lubin . | |
| 3,735,862 | * | 5/1973 | Nimmo, Jr. | 53/430 |
| 3,962,957 | | 6/1976 | Hinzmann . | |
| 3,996,842 | | 12/1976 | Ehlich et al. . | |
| 4,060,236 | * | 11/1977 | Carstedt | 493/459 |
| 4,080,242 | | 3/1978 | Kimenda et al. . | |
| 4,138,048 | | 2/1979 | Lemmon . | |
| 4,217,745 | * | 8/1980 | Watzka | 53/202 |
| 4,681,723 | | 7/1987 | Jester . | |
| 4,713,267 | | 12/1987 | Truskolaski . | |
| 4,952,281 | | 8/1990 | Akira . | |
| 4,980,942 | | 1/1991 | Spargo, Sr. . | |
| 5,120,296 | | 6/1992 | Yamaguchi . | |
| 5,141,484 | * | 8/1992 | Akira | 493/459 |
| 5,154,688 | | 10/1992 | Boyd . | |
| 5,192,261 | | 3/1993 | Hanjo . | |
| 5,257,492 | | 11/1993 | Watts . | |
| 5,383,837 | | 1/1995 | Watts . | |
| 5,400,452 | | 3/1995 | Goldstein . | |
| 5,407,417 | | 4/1995 | Goldstein . | |
| 5,460,590 | * | 10/1995 | Greiner et al. | 493/50 |
| 5,470,620 | | 11/1995 | Weder . | |
| 5,518,492 | * | 5/1996 | Goldstein | 493/459 |
| 5,711,752 | * | 1/1998 | Goldstein | 493/459 |
| 5,725,467 | * | 3/1998 | Chehab et al. | 493/50 |

FOREIGN PATENT DOCUMENTS

| | | |
|---|---|---|
| 3 421 175 | 12/1985 | (DE) . |
| WO91/16178 | 10/1991 | (WO) . |

OTHER PUBLICATIONS

Breif of Defendant–Appelle Hallmark Cards, Incorporated.*
Reply Brief of Plaintiff–Appellant Group One Ltd.*
Opening Brief on Plantiff–Appellant Group One Ltd. In Group One Ltd., v.Hallmark Cards Inc., Dec. 1999.

* cited by examiner

*Primary Examiner*—Eugene L. Kim

(57) ABSTRACT

A device for curling polypropylene ribbon comprises means (12) for delivering a supply of curlable ribbon, curling means (17) for the ribbon, and drive means (31–33) for drawing the ribbon across said curling means. The device may include guide means to control the approach angle of ribbon to the curling means, drag means to impose drag on said ribbon, and shredding means to shred said ribbon subsequent to curling.

9 Claims, 3 Drawing Sheets

RIBBON CURLING AND SHREDDING DEVICE

This is a Continuation of U.S. patent application Ser. No. 08/902,538, now U.S. Pat. No. 5,916,081 filed Jul. 29, 1997 which is a Continuation of U.S. patent application Ser. No. 08/650,493, filed May 20, 1996, now U.S. patent No. 5,711,752 which is a Continuation in part of U.S. patent application Ser. No. 08/244,022 filed May 13, 1994, now U.S. Pat. No. 5,518,492.

This invention relates to a ribbon curling and shredding device, and particularly to a device suitable for curling and for shredding polypropylene ribbon at a rapid rate and for mass production.

Hand-held ribbon curling and shredding devices are known and are used for curling the ends of polypropylene ribbon ties. Typically such ribbon is used for tying up a gift parcel and, after making the final knot, the free ends of the ribbon are curled. Such curling makes an attractive flower like addition and has the advantage of hiding the ribbon knot.

In use the devices imposes a permanent shear stress on one side of the ribbon, the amount of stress determining whether the curls are loose or tight.

A disadvantage of prior devices is that if the user is inexperienced or makes a mistake, the ribbon may be imprecisely curled or accidentally stressed on both sides. This often results in having to tie the parcel again in order to obtain two fresh ends with which to apply the curling device.

Optionally such curling devices may include one or more shredding blades which slice the ribbon lengthwise. The shredding blades increase the number of curly ends and are usually applied to the ribbon after it has been drawn across a curling edge.

To overcome the aforementioned problems the present invention provides means for curling and/or shredding continuous lengths of polypropylene ribbon, the treated ribbon being pulled tight for wrapping and tying parcels and the free ends automatically adopting a curled form without any additional operation. Alternatively, plain uncurled ribbon could be used to tie a parcel, and curled ribbon be tucked under the knot to provide an attractive feature which hides the knot; two or more colours may be used.

According to the invention there is provided a ribbon curling device comprising in sequence means for delivering a supply of unstressed curlable ribbon, curling means for said ribbon, and drive means for drawing said ribbon across said curling means. Preferably the device includes shredding means downstream of said curling means.

Such a device is capable of curling and shredding ribbon at rates which are suitable for mass production. Curled and shredded ribbon produced in this way may be used in individual strands for parcel tying and the like, or used in place of shredded tissue as a stuffing material for boxes or bags. A mass of curled and shredded ribbon may also be used for rapid balloon decoration, thereby avoiding the rather tedious curling and shredding of individual ribbon strands.

Alternatively the device may be used as a table top attachment in shops to provide a readily supply of curled and shredded ribbon.

Preferably said drive means comprises a train of wheels, the wheels imposing a tractive effort on said ribbon. In a preferred embodiment the train comprises three wheels, the ribbon being guided between said first and second wheels, around said second wheel and between said second and third wheels. In this preferred embodiment said second wheel is driven by a motor, and said first and third wheels are idlers. Alternatively the tractive device may comprise adjacent belts or wheels in pressing contact and between which the ribbon is squeezed.

The drive means are typically driven by electric motor so that in a shop installation the assistant may produce the required amount of curled ribbon, with or without shredding, at the touch of a button. Such drive means may be driven in response to a coin-operated device or other money payment system.

The device may include drive wheels having adjacent tracks for different ribbon colours and selectively engageable by clutch means to a tractive device such as an electric motor.

The size of the curling and shredding device is determined by the volume and speed of ribbon to be curled and shredded. It is envisaged that an in-store device might measure for example 400 mm×150 mm×150 mm. Larger machines for continuous mass production of curled and shredded ribbon are also envisaged.

Preferably the device includes means to vary the approach angle of said ribbon to a blade constituting said curling means. Typically an abutment may be provided to guide the ribbon to the curling blade; the abutment must be radiused in order to prevent undue stressing of the ribbon. Alternatively a roller may be provided. The abutment is preferably adjustable in order that the approach angle may be varied to suit the quality of ribbon used and the desired degree of curl tightness.

In an alternative embodiment the device includes drag means for ensuring a substantially constant drag force on ribbon approaching the curling blade. In one embodiment the ribbon is squeezed between two members acting as a ribbon brake. Where a guide roller is provided, drag may be by way of a roller brake. In another embodiment the drag force may be generated by a fixed surface over which the ribbon rubs; in this case it may be necessary to vary the position of the drag surface to compensate for the varying departure angle of the ribbon as the spool unwinds. It is essential that such drag means are sufficiently radiused to avoid any curling stress being imparted to the ribbon; thus the path from the drag means to the curling edge should be generally straight and unobstructed. Sharp edges, other than at the curling edge, should be avoided at all costs if a consistent curl is to be produced.

Where the approach angle is less than about 20°, and depending on ribbon quality, no drag means are necessary; sufficient drag is generated by the approach angle, and the apparatus may include drag free guide means to vary the approach angle accordingly. Drag may alternatively be provided by a ribbon reel brake.

The unstressed ribbon may be mounted on a spool, or may comprise a ball, or may be supplied directly from ribbon making apparatus.

Preferably the device further includes blade means to separate said ribbon from said drive means. The blade means may include a stripping edge or air blowing means.

In a preferred embodiment the device may include shredding means downstream of said curling means and operable to shred said ribbon lengthwise. Means may be provided to move said shredding means into and out of operative contact with said ribbon. Means may further be provided to move said shredding means intermittently into contact with said ribbon thereby to produce lengths of shredded ribbon connected by webs of unshredded ribbon.

Where the device includes three wheels, the shredding means may be located between the second and third wheels.

In an alternative embodiment said shredding means may be between the curling means and drive means. Preferably the device includes an arcuate ribbon guide downstream of said curling means and for guiding said ribbon to said drive means, said shredding means being upstanding from said guide on the convex surface thereof. The convex surface of the ribbon guide is preferably in the opposite direction to that in which the ribbon tends to curl on exit from the curling blade, and will tend to press the shredding means against the ribbon as it curves around the guide.

The use of an arcuate guide between the curling means and the drive wheels also results in the ribbon approaching the drive wheels at other than the shortest distance between the curling arm and drive wheels. Such a guide may thus advantageously be used to increase the contact area between the ribbon and the first drive wheel.

The device may alternatively include guide apparatus to guide the ribbon from said second wheel to said shredding means; the guide apparatus may comprise a support extending transversely to the ribbon, or a wheel. Such apparatus is useful in preventing the ribbon wandering and thus ensuring shredded strips of consistent width.

In a further embodiment the drive means may have shredding blades mounted directly thereon for continuous or intermittent but continual shredding.

In the preferred embodiment the ribbon is driven by being squeezed between adjacent wheels of the train; the outermost wheels of the train may be flanged to guide the ribbon therebetween. Preferably the wheel width between flanges should be substantially the same as the ribbon width in order to ensure accurate guidance without wandering of the ribbon between flanges. The device may permit wheels of alternative width to be fitted to suit ribbons of different width. Such drive wheels may be fitted with a high grip material to increase tractive effort on the ribbon.

Other features of the invention will be apparent from the following description of a preferred embodiment and alternatives shown by way of example with reference to the accompanying drawings in which.

Figures 1, 2, 3:
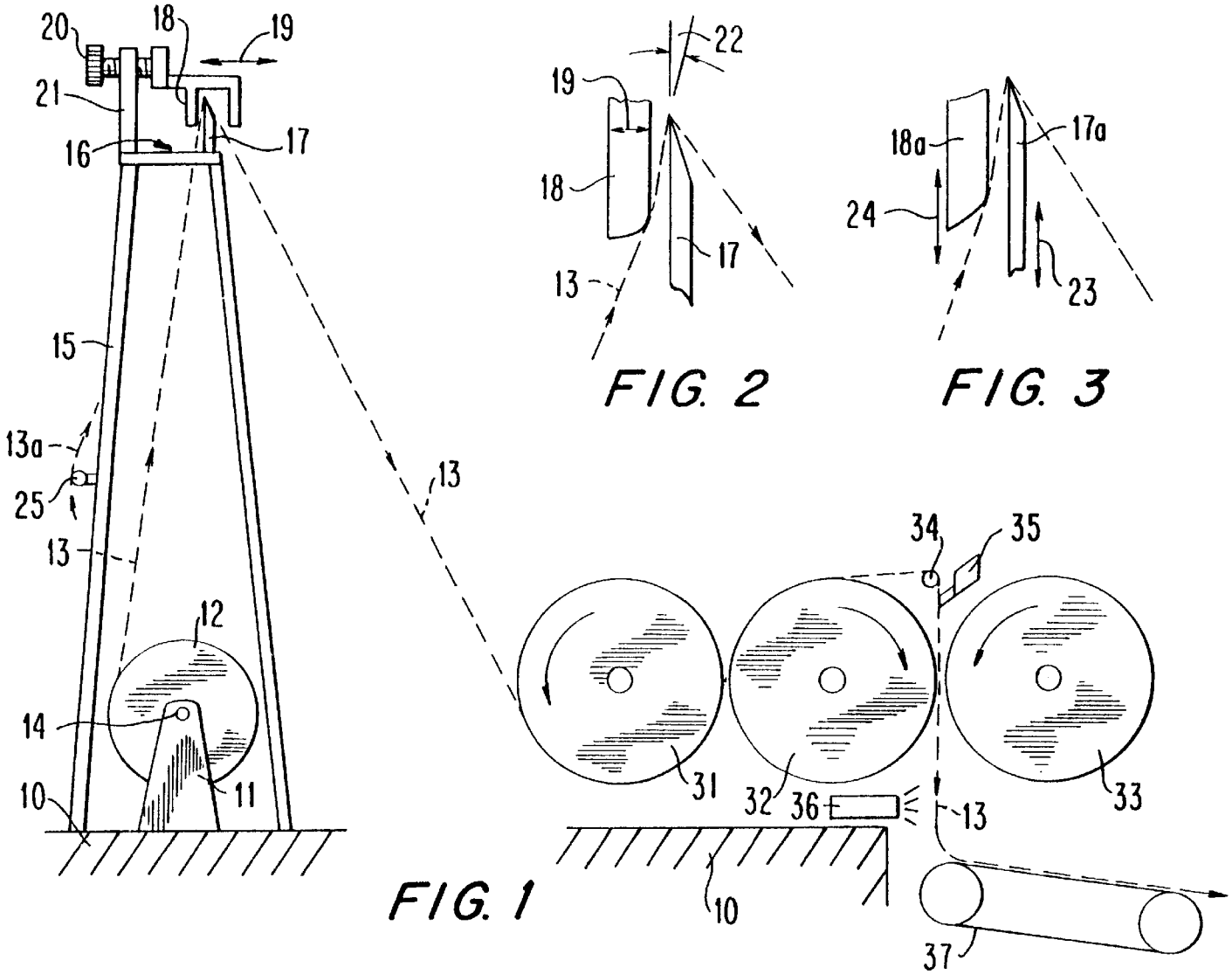
FIG. 1 is a schematic elevation of a device constructed in accordance with the invention.
FIG. 2 is an enlarged elevation of a curling blade illustrated in FIG. 1.
FIG. 3 is another enlarged elevation of a curling blade illustrated in FIG. 1.

With reference to the drawings, FIG. 1 illustrates a base 10 on which is mounted a support 11 for a reel 12 of polypropylene ribbon 13. The support may comprise upstanding end plates (which may be triangular as illustrated) having a spindle 14 therebetween and about which the reel 12 is free to rotate in use. Suitable means, not shown, permit the spindle 14, to be released so allowing an empty reel to be replaced. The reel may have a brake to impose a drag force on the ribbon.

A generally triangular frame 15 upstanding from the base has an aperture 16 at the apex approximately over the centre line of the spindle 14; in the embodiment illustrated the aperture is in a top plate of the frame and of sufficient width and depth to suit the maximum and minimum reel diameters, and the length of the reel.

On one side of the aperture 16 is an upwardly directed curling blade 17 whose function will be described below. A curling arm 18 supported by any suitable means controls the approach angle of the ribbon to the blade 17.

The curling arm 18 is supported for movement orthogonal to the ribbon in the direction illustrated by arrow 19. The position of the arm 18 may be altered by means of an adjuster screw 20 threaded in an upstanding extension 21 of the frame 15.

FIG. 2 illustrates the inner downwardly extending limb of the curling arm 18, and the curling blade 17; the arm causes the ribbon to adopt a desired approach angle to the blade and thus ensure consistent curling of the ribbon as the reel 12 unwinds. The adjuster screw 20 enables the approach angle 22 to be varied depending on the tightness of the desired ribbon curl and the range of effective spool radius. The ribbon may alternatively be taken around a fixed abutment 25 to ensure that the ribbon 13*a* approaches from a fixed point regardless of the effective radius of the spool 12.

A series of three wheels 31,32,33 supported by any suitable means on the base 10 are arranged in contact with one another as illustrated. The wheels are of approximately the same diameter, the centre most 32 being motor driven. The outermost wheels 31,33 are idlers, the direction of rotation of each wheel being shown by arrows.

The outermost wheels 31,33 may include edge flanges (not shown) to prevent the ribbon wandering sideways off the wheels; the guide flanges are preferably set apart by slightly more than the actual ribbon width. The wheels may be interchangeable with others to suit different ribbon widths.

Ribbon 13 from the spool 12 passes upwardly through the aperture 16, over the curling blade 17, around and underneath wheel 31, over wheel 32 and between wheels 32 and 33 as illustrated. The ribbon is driven by motor driven wheel 32 on both sides thereof.

Above and between wheels 32 and 33 is a guide wheel or rod 34 around which the ribbon passes before being driven between wheels 32 and 33. Downstream of the guide wheel is a ribbon shredding device 35 having a plurality of shredder blades aligned with the direction of ribbon movement.

An air blower 36 downstream of wheel 33 ensures that shredded ribbon does not cling to wheel 32 and thus snag or jam the machine.

Shredded ribbon may be transported by a conveyer 37, as illustrated, to a packing or storage location. The conveyer may be used in place of or in addition to the blower 36.

In use the curling edge 17 imposes a permanent shear stress on one side of the ribbon 13 causing it to adopt a curled form in the free state. The ribbon 13 is pulled through the train of wheels 31,32,33 under light tension which holds the ribbon straight notwithstanding the tendency to curl. On exit from the train of wheels the ribbon immediately adopts a curled state and in that form is transported for storage or packing.

The tightness of curl is a function of ribbon tension over the blade, and the precise approach angle chosen.

FIG. 3 illustrates the effect of means, not shown, which permit variation of the approach angle to blade 17*a*, by varying the height of the curling blade 17*a* above the spool, the curling arm 18 being fixed. Movement of curling blade 17*a* may be in response to a screw-threaded adjuster and in the direction indicated by arrow 23. Alternatively the curling arm 18 may be moved vertically with respect to a fixed blade as indicated by arrow 24.

The diameter of the wheels 31–33 should not be such as to stress the "wrong" side of the ribbon thereby causing permanent shear stresses to be imposed in opposition to the stresses applied by the curling edge 17.

The idler wheel 34 is optional but provides a convenient way of guiding the ribbon to the shredding device 35. In the preferred embodiment the shredding device is mounted on means, not shown, which permit the shredding blades to be engaged and disengaged from the ribbon as desired. In place of the blower 36 a fence or other means of stripping the ribbon from wheel 32 could be provided. In some embodiments and with suitable attention to wheel design, the blower may be optional.

The train of wheels 31–33 may include additional members,:or each wheel may be replaced by a spoked 'ferris wheel' arrangement in which spaced arms contact the ribbon at spaced locations. The ribbon could alternatively be pulled over the curling blade 17 by a conveyer belt working against a fixed roller or another belt.

The invention has been described with the intermediate wheel 32 motor driven. Alternatively the wheel 32 could be driven by hand. In other embodiments, the first or last wheel in the train, or any other wheel, could be driven with the same effect by virtue of the driving connection between the adjacent wheels.

The ribbon spool 12 may be positively driven by contact with wheel 31 or by chain or belt drive. Alternatively spool 12 may be independently driven at a speed governed to suit the effective spool diameter (which changes as the ribbon unwinds) or arranged to impose a drag force on the ribbon in opposition to the tractive effort imposed by the train of wheels 31–33.

A drag force could be imposed on the spool 12 by a separate brake means to adjust the braking effect—for example a screw down friction brake or a pulley tension system.

Figure 4:
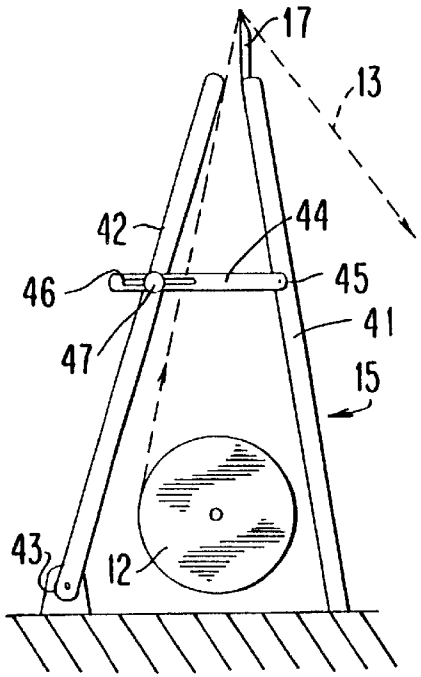
FIG. 4 shows an alternative support for the curling blade of the device.

An alternative apparatus for adjusting approach angle is illustrated in FIG. 4. The frame 15 has a fixed leg 41 on which the blade 17 is mounted, and a movable leg 42 connected to the base 10 by a hinge 43. A stay 44 hinged to arm 41 at 45 supports leg 42 at any desired spacing by virtue of slot 46 through which passes a clamping screw 47. The upper end of leg 42 is rounded and is adapted to contact ribbon 13 to impart a predetermined approach angle to the blade 17. The angle of leg 42 is varied by releasing screw 47 moving leg 42 to a desired position, and reclamping screw 47, thereby varying the approach angle of the ribbon to the drag means which is constituted by the end of the leg 42 in contact with the ribbon 13.

Figure 5:
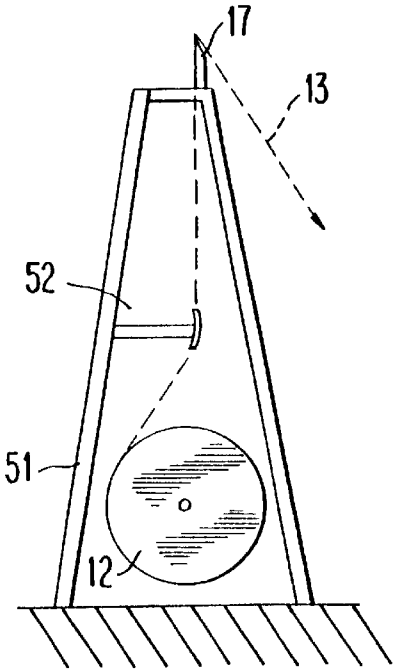
FIG. 5 shows another alternative support for the curling blade of the device.

Yet another arrangement is illustrated in FIG. 5. In this apparatus the legs of frame 15 are fixed in relation to the blade 17. Mounted on the leg 51 adjacent the unwinding ribbon is a curved support 52 which imparts a precise approach angle to the ribbon 13. The approach angle may be varied by moving support 52 vertically or horizontally, or by moving the axis of spool 12. Suitable threaded adjusters may be provided to effect adjustment; the support 52 may for example be mounted on a carriage slidable with respect to the frame 15. The support 52 may carry a friction material to exert greater drag on the ribbon 13.

In the embodiments of FIGS. 4 and 5, the ribbon drag force imposed by the leg 42 or support 52 may vary as the spool unwinds. Accordingly it is preferable to include means to impose a constant drag force as noted above.

Furthermore it may be necessary to adjust the drag force, or provide additional drag from for example a ribbon reel brake, where the guide is a long way from the curling blade.

Figure 6:
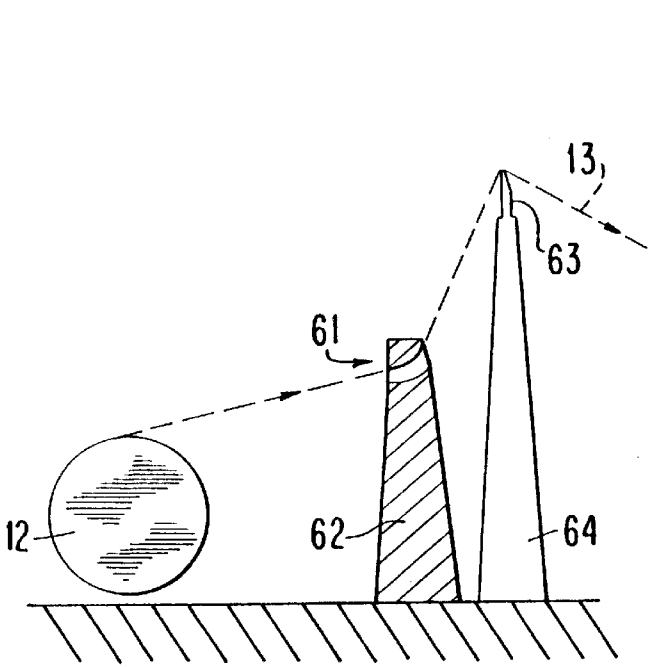
FIG. 6 shows apparatus for adjusting the approach angle of ribbon to the curling blade of the device.

FIG. 6 illustrates yet another arrangement, in which ribbon is guided from a spool 12 to a guide 61 mounted on a stand 62 and thence to a curling blade 63 mounted on another stand 64. The approach angle to the blade may be varied by adjusting the relative distance between stand 62 and stand 64, or by adjusting the height of the guide 61 on the stand relative to the height of the curling blade 63.

The drag force in this embodiment may be held constant for example by squeezing the ribbon between the guide 61 and the stand 62. The drag force may be varied by constructing guide 61 as a screw-down friction brake.

Figure 7:
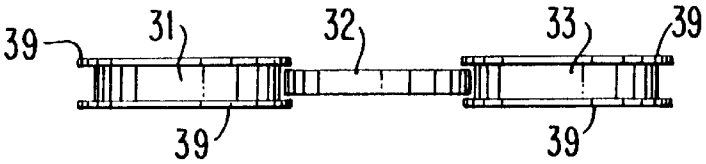
FIG. 7 is a plan view of a train of three drive wheels.

FIG. 7 illustrates nested wheels in which the ribbon is guided by shoulders 39 of the outermost wheels 31,33, the illustrated gap between the wheels being intended to be slightly less than ribbon thickness.

Figure 8:
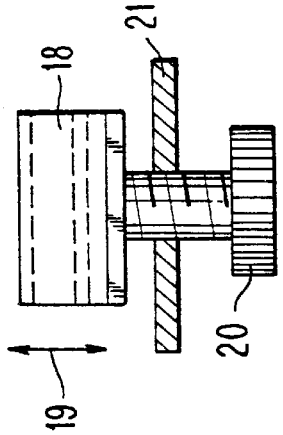
FIG. 8 is a partial plan view of an adjustable curling arm illustrated in FIG. 1.

FIG. 8 is a view of the curling arm from above and showing the upstanding extension 21.

Figure 9:
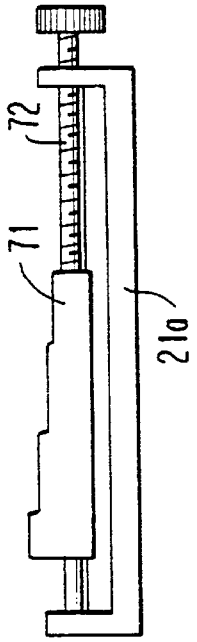
FIG. 9 is an alternative adjustable curling arm.
Figure 10:
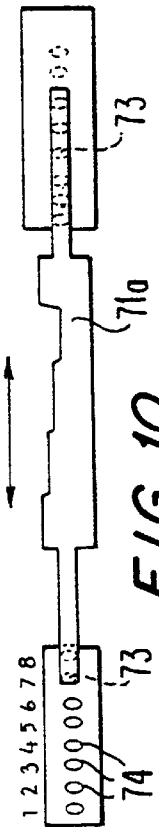
FIG. 10 is yet another adjustable curling arm.

FIG. 9 illustrates an alternative curling arm assembly and having a stepped arm 71 mounted on an upstanding extension 21*a* of the frame 15. A screw threaded adjuster 72 moves the curling arm laterally along the extension 21*a* to bring an appropriate step of the arm 71 into contact with the ribbon thereby to alter the angle at which the ribbon approaches the blade 17. Alternatively the arm 71 may be mounted for movement between fixed positions determined by e.g. one or more pegs 73 and a plurality of slots 74 as illustrated in FIG. 10. The arm 71*a* may be guided on the frame 21*a* by any convenient means.

Figure 11:
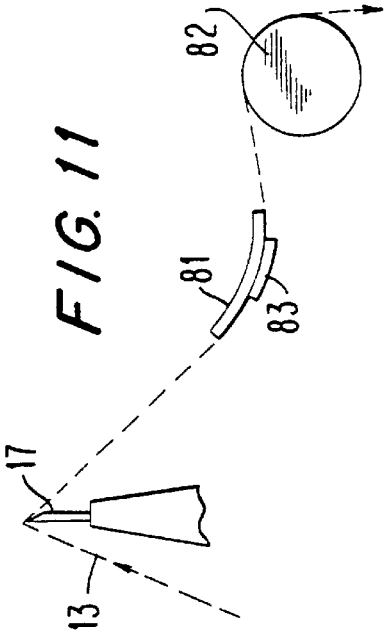
FIG. 11 illustrates an arcuate ribbon guide downstream of the curling blade.

FIG. 11 illustrates an arcuate guide 81 under which the ribbon 13 passes from curling blade 17 to drive wheel 82 which may be the first in a train of wheels. The guide 81 may have one or more downwardly extending shredding blades 83 and/or downwardly extending shoulders to prevent lateral movement of the ribbon. The guide 81 comprises a ribbon guide forming a convex guide surface which controls the approach angle of ribbon to said drive wheels 31, 32, 33.

Figure 12:
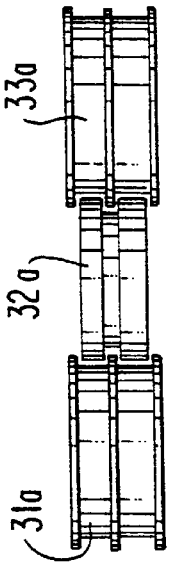
FIG. 12 is a plan view of a train of three drive wheels with parallel tracks.

FIG. 12 illustrates in plan an alternative to the arrangement of FIG. 7, in which the train of drive wheels 31*a*, 32*a*, 33*a* have a plurality of parallel tracks, each for engagement with a different ribbon strand.

As illustrated the use of the guide both ensures that the ribbon is drawn against the guide underside, and increases the peripheral contact area of the drive wheel 82, as compared with the contact area where no guide is present.

The drawings accompanying this specification are schematic and illustrative. Accordingly many parts are shown in suitable relation to one another but with clearances and dimensions exaggerated or reduced in order to properly illustrate the embodiments described. Many of the embodiments may be modified to suit particular circumstances and to include features disclosed in relation to other embodiments.

I claim:

1. A ribbon curling device comprising:

delivery means for delivering a supply of at least two unstressed curlable ribbons;

curling means located downstream of said delivery means for curling the at least two ribbons;

drive means located downstream of said curling means for drawing the at least two ribbons across said curling means, a plurality of tracks, said tracks including guides, said guides for engagement with a different ribbon strand of said at least two curlable ribbons; and stripping means for removing the at least two curled ribbons away from said drive means.

2. A device according to claim 1 wherein said curling means comprises an upstanding curling blade.

3. A device according to claim 1 and further including means to vary the approach angle of ribbon to said curling means.

4. A device according to claim 1 and further including ribbon drag means upstream of said curling means.

5. A device according to claim 4 wherein said drag means are adjustable to vary the drag force imposed on ribbon in use.

6. A device according to claim 4 wherein said drag means are adjustable to vary the approach angle of ribbon to said curling means.

7. A device according to claim 4 wherein said drag means are adjustable to vary the approach angle of ribbon to said drag means.

8. A ribbon curling device comprising:

delivery means for delivering a supply of at least two unstressed curlable ribbons, the delivery means including a supply of at least two different color curlable ribbons;

curling means located downstream of said delivery means for curling the at least two ribbons;

drive means located downstream of said curling means for drawing the at least two ribbons across said curling means, a plurality of tracks, said tracks including guides, said guides for engagement with a different ribbon strand of said at least two curlable ribbons; and stripping means for removing the at least two curled ribbons away from said drive means.

9. A ribbon curling device comprising:

delivery means for delivering a supply of at least two unstressed curlable ribbons, curling means located downstream of said delivery means for curling the at least two ribbons:

drive means located downstream of said curling means for drawing the at least two ribbons across said curling means, a plurality of tracks, said tracks including guides, said guides for engagement with a different ribbon strand of said at least two curlable ribbons;

stripping means for removing the at least two curled ribbons away from said drive means; and a first strand of curled ribbon has a first color and a second strand of curled ribbon has a second color different than the first color.

* * * * *